United States Patent [19]

Birkle et al.

[11] Patent Number: 4,696,728

[45] Date of Patent: Sep. 29, 1987

[54] APPARATUS FOR MASS ELECTROPLATING OF BULK GOODS

[75] Inventors: Siegfried Birkle, Höchstadt/Aisch; Johann Gehring, Spardorf, both of Fed. Rep. of Germany

[73] Assignee: Siemens Aktiengesellschaft, Berlin and Munich, Fed. Rep. of Germany

[21] Appl. No.: 906,037

[22] Filed: Sep. 11, 1986

[30] Foreign Application Priority Data

Sep. 17, 1985 [DE] Fed. Rep. of Germany ..... 3533151
May 15, 1986 [DE] Fed. Rep. of Germany ..... 3616429

[51] Int. Cl.[4] ..... C25D 17/16
[52] U.S. Cl. ..... 204/213
[58] Field of Search ..... 204/212, 213, 214, 275

[56] References Cited

U.S. PATENT DOCUMENTS 4,360,409 11/1982 Stoeger et al. ..... 204/213

FOREIGN PATENT DOCUMENTS 830862 2/1952 Fed. Rep. of Germany ..... 204/213

*Primary Examiner*—T. M. Tufariello
*Attorney, Agent, or Firm*—Hill, Van Santen, Steadman & Simpson

[57] ABSTRACT

An apparatus for the mass electroplating of bulk goods comprising a plating tank for the acceptance of an electrolyte, a goods carrying dish immersed in the electrolyte and rotatable around an inclined axis, a disk-shaped electrode immersed in electrolyte and extending mainly parallel to the floor of the carrying dish characterized by the floor of the carrying dish having a helically extending track which will spread the goods throughout the floor during a plating operation. The helical track preferably has a saw-toothed cross section and the dish preferably has one sliding door in a peripheral wall to enable discharge of the goods from the dish after the plating operation. The plating tank is preferably gas tight and is provided with admission and discharge locks so that it is particularly useful for mass aluminum-plating utilizing an aprotic, oxygen-free and water-free, aluminum-organic electrolyte.

21 Claims, 3 Drawing Figures

100
Bb
Wa
Sch

100
Es
Bb
Esp
Fr
Dp1
G
Ac
B
A
D
W
Lg
Aw
U
Sch
Be
α
Vz
Wa
Da
Dp2
Ao1
As
Ge
Ao2

APPARATUS FOR MASS ELECTROPLATING OF BULK GOODS

BACKGROUND OF THE INVENTION

The present invention is directed to an apparatus for the mass electroplating of bulk goods, particularly for the electro-deposition of aluminum from an aprotic, oxygen-free and water-free, aluminum-organic electrolyte. The apparatus includes a plating tank for the acceptance of an electrolyte, a goods carrying dish being mounted to rotate on a incline axis in the plating tank and being immersed in the electrolyte, at least one disk-shaped anode dipping into the electrolyte and being aligned to be mainly parallel to a floor of the goods carrying dish and the goods carrying dish having at least one dog or ridge for spreading the goods on the floor of the carrying dish as the dish rotates.

In mass electroplating of bulk goods, the goods for galvanization must be held together so that during the galvanic processing, every individual part has electrical contact. On the other hand, the goods for galvanization should be spread out as far as possible so that the metal deposition can occur on the largest possible surfaces of the goods and an optimally uniform current density is guaranteed on all parts. These two demands must be fulfilled by the apparatus being used. A further significant condition for achieving faultless metal coatings with a uniform layer thickness is the adequate mixing of the goods for galvanizing during the galvanic processing. This mixing of the goods for galvanization is usually obtained by turning the goods vessel around a non-perpendicular axis so that dependent on the shape and wall friction, the individual parts are conveyed up to a greater or lesser distance on the goods tray and then in turn will roll back down or slide down the tray. However, despite this goods movement, a good electrical contact and a gentle treatment of the goods for galvanization should be guaranteed. Also, for quantitatively high-grade metal coatings, additional requirements or demands are made and these are requirements for an adequate electrolyte exchange, an optimally unimpeded current transfer between the anodes and the goods being galvanized and an adequate size and surface for the anode in relation to the surfaces of the goods being treated.

The simplest vessel for goods is the electroplating bell or a rotatable pot, which simultaneously serves as a plating tank. A mixing of the goods for galvanization is achieved in that the bell is mounted with its axis inclined relative to the perpendicular and is rotated around this axis. Since the anode is suspended into the bell, the anode surface itself is usually too small in comparison to the surface of the goods given an employment of profiled special anodes. This, however, then leads to low deposition rates and thus, to a lengthening of the electroplating duration and to an increase of the abrasion on the parts or goods.

Electroplating drums are also frequently employed for mass electroplating and these drums in contrast to the bell only serves as vessels for the goods and are arranged in a plating tank. A mixing of the goods for galvanization is effected by turning the electroplating drum around a horizontal axis. Since the anodes are situated outside of the drum member, large anode surfaces can be obtained. On the other hand, a perforation must be introduced into the jacket of the drum member for the current passage between anodes and the goods for galvanization. However, for reasons of stability and in view of the size of the goods being plated or galvanized, the open cross section of these perforations, which is available for the current passage, is dimensioned so small that a considerable deterioration of the current passage will occur. This, however, then again leads to a low deposition rate and thus, to a lengthening of the electroplating duration or time and to an increase of the abrasion of the goods being treated.

German Pat. No. 830,862 discloses an apparatus of the species initially cited wherein the goods are placed in a carrying dish which is provided with ribs on its inside. These ribs promote a uniform distribution of the bulk goods on the floor of the goods carrying dish. Given a rotation of the goods carrying dish, the ribs upwardly entrain the bulk goods so that a degree of spreading relative to the floor of the goods carrying dish is considerably enhanced by the ribs. Both the carrying dish for the goods as well as the vessel serving for the acceptance of the completely electroplated goods are pivotably seated around a common shaft that is seated above the plating tank so that both vessels can be brought into a mutual position to allow the bulk goods to be emptied from the goods carrying dish into the acceptance vessel which is then pivoted out of the electrolyte as the goods carrying dish is returned to the working position. The discharge of the completely electroplated goods, thus, involves a considerable outlay of time.

Aluminum deposited from an aprotic, oxygen-free and water-free, aluminum-organic electrolyte is distinguished by its ductility, low number of pores, corrosion resistance and capabilities of being anodically oxidized. Since, due to the reaction with atmospheric oxygen and atmospheric humidity, the access of air will cause a considerable reduction of the conductivity and useful life of these electrolytes, the electroplating must be undertaken in a means operating under the exclusion of air. So that the access of air can also be prevented during loading and unloading of this apparatus which operates under a protective atmosphere that excludes air, inward transfer and outward transfer locks are also required and these are fashioned as gas locks, as liquid locks or as combined gas/liquid locks. In mass aluminization utilizing the aprotic, oxygen-free and water-free, aluminum-organic electrolyte, the additional problem of preventing the access of air to the electrolyte in so far as possible is also added to the difficulties already set forth.

U.S. Pat. No. 4,360,409, which is based on German Pat. No. 30 23 129, discloses an apparatus for electrodeposition of aluminum from an aprotic, oxygen-free and water-free, aluminum-organic electrolyte, wherein the electroplating drum rotates about its horizontal axis and is arranged in a plating tank which can be closed gas tight. The electroplating drum is provided with perforations and is surrounded by two anodes which can be adjusted so that they form an opening for the bulk goods to be emptied through. The loading of the electroplating drum occurs via a conveyor means leading into the inside of the plating tank through a lock and this conveyor means ends above a closable opening of the electroplating drum so that the opening and closing of the electroplating drum is undertaken from the outside. A discharge vessel is fashioned as an outward transfer lock and serves the purpose of emptying the electroplating drum. This discharge vessel is arranged below the plating tank and is in communications therewith via a blockable, tubular connecting member.

In the known apparatus for electro-deposition of aluminum, the problem of preventing the access of air to the electrolyte has been satisfactorily resolved. As in other apparatuses for drum electroplating, a deterioration of the current passage between the anodes arranged outside of the drum member and the goods being plated and situated in the inside of the drum can, however, also occur.

SUMMARY OF THE INVENTION

The object of the present invention is to provide an apparatus for mass electroplating of bulk goods which will provide an improved degree of the spreading of the goods on a floor of a carrying dish. With a justifiable additional outlay, the apparatus can be operated with an exclusion of air and be utilized for mass aluminum plating with an employment of an aprotic, oxygen-free and water-free, aluminum-organic electrolyte.

These objects are achieved in an improvement in an apparatus for mass electroplating of bulk goods, said apparatus including a plating tank for the acceptance of an electrolyte, a goods carrying dish having an axis and a floor, means for rotatably mounting the dish in the tank with the dish immersed in the electrolyte and the axis inclined, and at least one disk-shaped anode immersed into the electrolyte and aligned mainly parallel to the floor of the dish, said dish having at least one dog for spreading the bulk goods on the floor of the goods carrying dish. The improvement is that the dog is formed by a helically extending track on the floor of the dish.

The helical track acts as a conveying means which constantly conveys the bulk goods from the lower region of the goods carrying dish into an upper region. As a result thereof, a completely uniform coverage of the floor of the goods carrying dish with bulk goods can be achieved and the helical track also greatly promotes a mixing of the goods as it spreads them. The track can be formed in an especially simple way by a profile introduced into the floor of the goods carrying dish. Particularly the entrainment of the goods into a more elevated region of the goods carrying dish can then be further improved with a profile having a saw-toothed cross section.

In order to improve the electrolyte exchange, the floor of the goods carrying dish can also be provided with perforations. In this case, an auxiliary anode can be positioned below the floor and can be aligned at a distance from and parallel to the floor. As a result of the additional anode, the anode surface is even further enlarged so that especially high deposition rates can be achieved.

In accordance with another peferred development of the invention, a slide for the discharge of the goods is arranged in a peripheral wall of the goods carrying dish or shell. When this slide is at its lowermost position in the tank and is opened, then an automatic emptying of all the goods in the dish will occur.

It has proven particularly favorable for a goods mixing of the goods when the angle of inclination of the axis of the goods carrying dish relative to a horizontal amounts to 30°–38°. When the angle of inclination of the axis of the goods carrying dish relative to a horizontal is variable, then a particularly good adaptation to requirements of the respective goods for galvanization is enabled in view of the spreading and mixing. The angle of inclination of the axis is then preferably adjusted by the oblique position of the overall plating tank. This takes the fact into consideration that given an adjustment of the axis, the parallel alignment of the anode relative to the floor of the goods carrying dish is to be maintained. A synchronized adjustment of the goods carrying dish and the anode can be guaranteed in an especially simple way by this oblique positioning of the overall plating tank. For the purpose of a simple modification of the oblique position, the plating tank is expediently pivotedly arranged on a frame.

The apparatus of the present invention can be utilized with relatively little additional outlay for the mass electroplating with an employment of an aprotic, oxygen-free and water-free, aluminum-organic electrolyte. This is achieved in that the plating tank is closable gas tight and in that the locks are provided for the admission and discharge of the goods. The plating tank is then preferably provided with a cover arranged in the region of the anode so that the anode is easily accessible when the cover is removed and thus, the anode can be replaced as needed without any problems.

DESCRIPTION OF THE PREFERRED EMBODIMENTS

Figure 1:
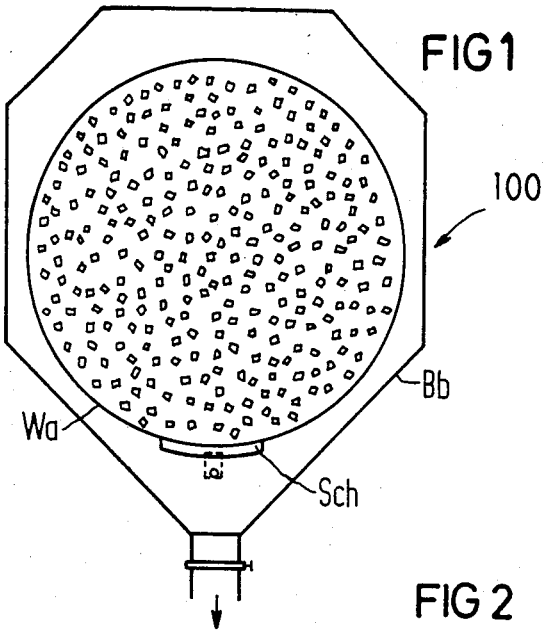
FIG. 1 is a schematic plan view of an apparatus in accordance with the present invention with portions removed for purposes of illustration.
Figure 2:
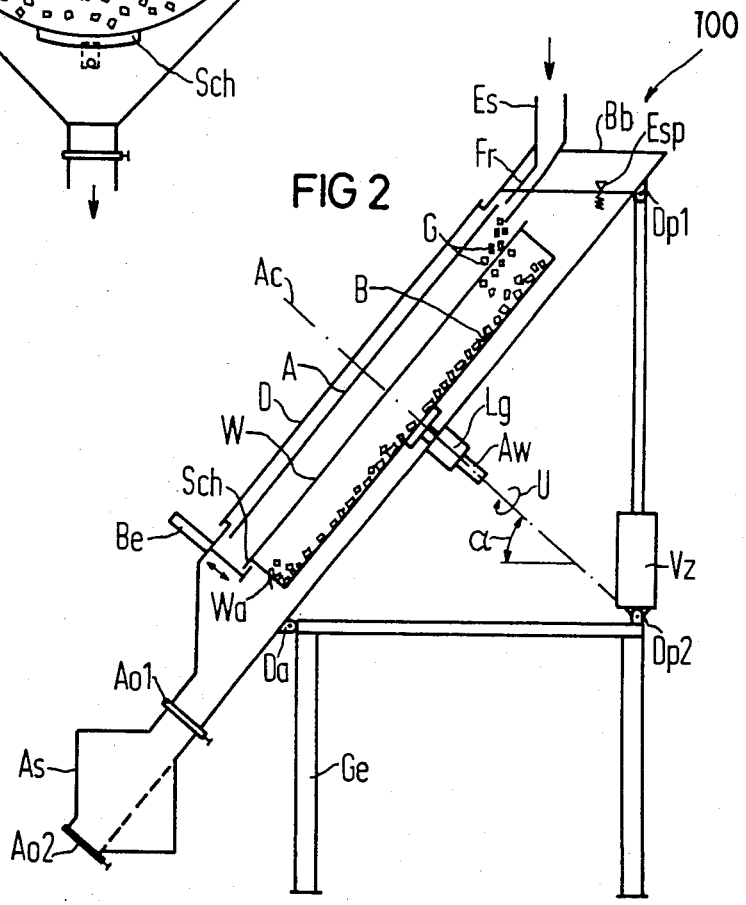
FIG. 2 is a longitudinal cross sectional view of the apparatus of FIG. 1.

The principles of the present invention are particulary useful when in corporated in an apparatus generally indicated at 100 in FIGS. 1 and 2. The apparatus 100 is for the mass aluminum plating of bulk goods G. An aprotic, oxygen-free and water-free, aluminum-organic electrolyte is situated in a plating tank Bb which is closed gas tight with the assistance of a removable cover D and which tank Bb is arranged obliquely on a frame Ge. As indicated, the electrolyte has a level Esp and the region above this electrolyte level Esp is charged with an inert gas, such as, for example, nitrogen.

To introduced the bulk goods or parts G, which are to be aluminum-plated and which, for example, can be screws, nuts, bolts, spacer bushings and the like, the apparatus 100 has an admission lock Es, which extends into an upper portion of the plating tank Bb and has an obliquely discharge pipe Fr connected thereto. The lock Es can be a conventional structure and is not shown in great detail. Goods introduced through the lock Es travel through the pipe Fr and are deposited onto a floor B of a goods carrying dish W which is immersed completely in the electrolyte. The goods carrying dish W comprises a shape of an extremely flat circular cylinder having a peripheral wall Wa.

When loading the goods G into the carrying dish W during electroplating operation, the goods carrying dish W is turned around its axis Ac and the goods carrying dish W and the tank Bb are inclined relative to a horizontal plane so that the axis Ac is inclined to the horizontal. The drive shaft Aw for the dish W is rigidly mounted on the floor B for rotation by a bearing housing Lg. The shaft is conducted through the wall of the plating tank Bb in a gas tight and liquid tight manner by the bearing housing Lg which is illustrated as being attached to the outer surface of the plating tank Bb. A drive is allocated to the drive shaft and is not illustrated but will rotate the shaft in the direction of the arrow U which is a clockwise direction. As illustrated, the axis Ac and the shaft Aw form an angle $\alpha$ with the horizontal plane.

A disk-shaped anode, which is schematically illustrated in FIG. 2, is arranged at a slight distance from and parallel to the floor B and thus, extends parallel to the goods G which are spread on the floor B. The insulated fastening of the anode A, which is composed of pure aluminum and is formed from a plurality of segments, in the plating tank Bb is conventional and not illustrated in detail. It may be seen, however, that the anode A can be easily replaced when the cover D is removed from the tank Bb.

During electro-deposition of the aluminum, the goods carrying dish W is turned around its inclined axis Ac in the direction of the arrow U so that the goods G are mixed at the same time. As a consequence of the unimpeded passage of the electroplating current between the anode A and the surfaces of the goods, high deposition rates can be achieved so that the goods G can be discharged after a relatively short plating time. For this purpose, a slide or sliding door Sch is arranged in the peripheral wall Wa of the goods carrying dish or tray. To operate the door Sch, the tank is provided with a pneumatic or hydralic actuating lift element Be which is secured adjacent the lowermost position of the door Sch as it rotates around the axis Ac. When the goods carrying dish is to be emptied, the actuator Be is actuated as indicated by the double arrow to open the door or slide and allow the goods to be completely discharged from the dish into the bottom of the tank Bb. The goods G then proceed into a lower funnel-shaped region at the bottom of the plating tank Bb, which has a first blocking member or gate Ao1 followed by a discharge vessel or lock As which is followed by a second blocking member Ao2. During removal of the goods, the following steps are obtained. The blocking member or gate Ao1 is opened so that the goods G and a part of the electrolyte can enter into the discharge lock As. Then the blocking member Ao1 is closed and the electrolyte is pumped out of the discharge lock As back into the plating tank Bb. After pumping out the electrolyte, the discharge lock is filled with a rinsing fluid, such as toluol, from a supply reservoir for rinsing the goods G. After allowing the toluol to rinse the goods, it is then pumped back into the supply reservoir and subsequently, the second blocking member or gate Ao2 is opened to allow discharging the goods from the lock As.

As best illustrated in FIG. 2, the plating tank Bb is obliquely mounted on the frame Ge so that it is in a slanting position which can be changed by pivoting the overall plating tank Bb. For this purpose, the lower region of the plating tank is hinged to the frame Ge by a hinge having a rotational axis Da whereas a pneumatic or hydraulic actuated adjustment cylinder Vz is hinged to an upper region of the tank via a first pivot point Dp1 and is hinged to the frame Ge at a second pivot point Dp2. In this way, the oblique position of the plating tank Bb and thus, the angle of inclination $\alpha$ for the axis Ac of the goods carrying dish W can be varied relative to the horizontal by the adjustment cylinder Vs. Under given conditions, the angle of inclination $\alpha$ is also reduced when emptying the dish W.

Figure 3:
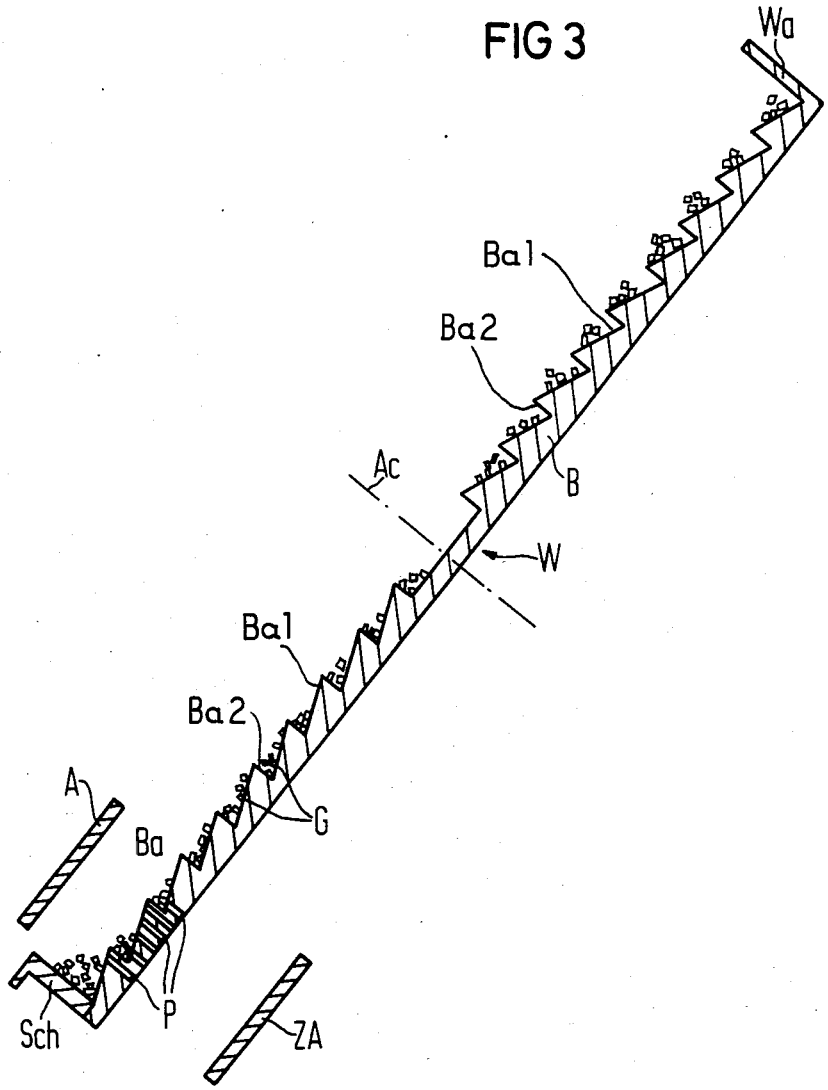
FIG. 3 is an enlarge detailed cross sectional view of the goods carrying dish in accordance with the present invention.

The following dimensions and operating values are provided for the apparatus 100 shown in FIGS. 1 and 2:

Diameter of the goods carrying dish W: 3.0 m
Bulk weight of the goods G: about 300 kg
Anode current density: 1.0 A/dm$^2$
Cathodic current density: 0.5–1.0 A/dm$^2$
Angle of inclination $\alpha$: 30°–38°.
Speed of rotation for the carrying dish W: 2–12 rpm The speed and angle of inclination $\alpha$ can be adapted to the particular goods which are to be aluminum-plated. Thus, a completely uniform spread of the goods G, as shown in FIG. 1, will occur. This optimum spreading of the goods is also effected by a dog or track whose manner and function are best illustrated in FIG. 3. The floor B of the goods carrying dish W is provided with a profile having a saw-toothed cross section. This profile forms a track Ba proceeding in a form of a helix. This track Ba forms an optimally acting dog, which, due to the rotation of goods carrying dish W, forms a conveying means which transports the goods from the lower region into the upper region of the goods carrying dish. The track Ba, as mentioned, has a saw-toothed configuration with an inclined surface Ba1 and a sharp step-like surface Ba2. When in the upper region, the goods will then slide down over the inclined surface Ba1 of the saw-toothed profile and this will create an extremely good mixing of the goods. It is possible to make the determination on the basis of trial, that for every type of goods, an angle of inclination $\alpha$ and a speed are available in which the goods will be spread nearly completely over the entire floor area of the goods carrying dish W and be mixed extremely well.

As indicated in the lower regions of FIG. 3, the base or floor B is provided with perforations P by which electrolyte exchange can be further improved. As also illustrated, an auxiliary anode ZA can be arranged in the tank at a distance from and parallel to the floor B. This auxiliary anode ZA, like the anode A which is also partially illustrated in FIG. 3, is composed of pure aluminum and is formed from a plurality of segments. The current passage is further improved by the perforations P and by the presence of the auxiliary anode ZA and thus, an additional enhancement of the deposition rate will occur. Multiple arrangements of good carrying dish W rotated on a common axis is also conceivable. In such an arrangement, the auxiliary anode ZA then will simultaneously serve as a principle anode of the lower goods carrying dish.

The dish W is either made of an electrically insulating material or is coating with an electrically insulating layer and is provided with contacts on the floor for contacting the goods being plated. To connect the contacts into the electrical circuit, a slip ring (not illustrated) is provided.

Although various minor modifications may be suggested by those versed in the art, it should be understood that we wish to embody with the scope of the patent granted hereon, all such modifications as reasonably and properly come within the scope of our contribution to the art.

We claim:

1. In an apparatus for mass electroplating of bulk goods, particulary for the electro-deposition of aluminum from an aprotic, oxygen-free and water-free, aluminum-organic electrolyte, said apparatus comprising a plating tank for the acceptance of an electrolyte, a goods carrying dish having an axis and a floor; means for mounting the goods carrying dish in the tank for rotation around an inclined axis and immersed in the electrolyte; and at least one disk-shaped anode being immersed in the electrolyte and aligned mainly parallel to the floor of the goods carrying dish, said dish having at least one dog for spreading the bulk goods on the floor of the carrying dish, the improvements comprising the dog being formed by a helically extending track.

2. In an apparatus according to claim 1, wherein the helically extending track is formed by a profile introduced into the floor of the goods carrying dish.

3. In an apparatus according to claim 2, wherein the profile has a saw-toothed cross section.

4. In an apparatus according to claim 3, wherein the floor of the goods carrying dish is provided with perforations.

5. In an apparatus according to claim 4, wherein an auxiliary anode is positioned in the tank at a distance beneath the floor and extends parallel to the floor.

6. In an apparatus according to claim 5, wherein a peripheral wall of the goods carrying dish has at least one openable door to allow discharging the goods from the dish.

7. In an apparatus according to claim 6, wherein the angle of inclination of the axis of the goods carrying dish relative to a horizontal plane amounts to between 30° and 38°.

8. In an apparatus according to claim 6, wherein the angle of inclination of the axis of the goods carrying dish relative to a horizontal plane is adjustable.

9. In an apparatus according to claim 8, wherein the means for mounting the dish in the tank mounts the dish rigidly relative to the tank, said tank and dish having the angle of inclination of the axis being adjustable by means mounting the tank for pivotable movement on a frame supporting said tank.

10. In an apparatus according to claim 9, wherein the means for mounting the tank includes an adjustment means for pivoting the tank on the frame.

11. In an apparatus according to claim 8, wherein the plating tank is closed gas tight and is provided with locks for the admission and discharge of the goods therefrom.

12. In an apparatus according to claim 11, wherein the plating tank is provided with a removable cover arranged in the region of the anode.

13. In an apparatus according to claim 1, wherein the floor of the goods carrying dish is provided with perforations.

14. In an apparatus according to claim 13, which includes an auxiliary anode positioned in the tank to extend parallel to the floor of the dish and being positioned below the floor of said dish.

15. In an apparatus according to claim 1, wherein the dish is provided with at least one sliding door in a peripheral wall of the dish to enable removal of the goods therefrom.

16. In an apparatus according to claim 1, wherein the angle of inclination of the axis of the goods carrying dish relative to a horizontal plane amounts to 30° to 38°.

17. In an apparatus according to claim 1, wherein the angle of inclination of the axis of the goods carrying dish is adjustable relative to a horizontal plane.

18. In an apparatus according to claim 17, wherein the angle of inclination of the axis of the goods carrying dish is adjustable by an oblique positioning of the overall plating tank.

19. In an apparatus according to claim 18, wherein the plating tank is pivotably arranged on a frame and the means for mounting the goods carrying dish mounts the dish rigidly to the tank for rotation so that the change of the axis is by pivoting the tank and dish together.

20. In an apparatus according to claim 1, wherein the plating tank is closed gas tight and is provided with locks for the admission and discharge of the goods.

21. In an apparatus according to claim 20, wherein the plating tank is provided with a cover in the region of the anode.

* * * * *